US005984408A

United States Patent [19]

Bujaryn

[11] Patent Number: 5,984,408

[45] Date of Patent: Nov. 16, 1999

[54] COMPOUND LEVER AND ARMREST MOUNTING ASSEMBLIES

[76] Inventor: L. Walter Bujaryn, P.O. Box 6368, Avon, Colo. 81620

[21] Appl. No.: 09/310,420

[22] Filed: May 12, 1999

Related U.S. Application Data

[63] Continuation of application No. 09/004,379, Jan. 8, 1998, abandoned.

[51] Int. Cl.[6] ..... A47C 1/031

[52] U.S. Cl. ..... 297/323; 297/411.32; 297/411.37; 297/411.39; 297/115

[58] Field of Search ..... 297/323, 411.32, 297/411.35, 411.39, 411.37, 115; 248/118

[56] References Cited

U.S. PATENT DOCUMENTS

| | | | |
|---|---|---|---|
| 1,731,709 | 10/1929 | Cropsey | 297/411.37 |
| 2,859,801 | 11/1958 | Moore | 297/323 |
| 4,277,102 | 7/1981 | Aaras et al. | 297/115 |
| 4,703,974 | 11/1987 | Brauning | 297/411.39 |
| 5,725,276 | 3/1998 | Ginat | 297/323 |
| 5,752,683 | 5/1998 | Novis et al. | 248/118 |

*Primary Examiner*—Anthony D. Barfield

*Attorney, Agent, or Firm*—Ramon L. Pizarro; Edwin H. Crabtree

[57] ABSTRACT

A system for supporting a seat-pan on a chair and for providing movement to an armrest on the chair. The system includes a mounting assembly with an upper rail having a front portion, a mid portion and a rear portion, and a lower rail having a front portion, a mid-portion and a rear portion. The upper rail is pivotally connected to the lower rail in a manner which allows g generally parallel motion of the rails relative to one another. An armrest support is pivotally attached to the mounting assembly, and includes a linkage for indexing movements of the armrest support relative to motion of the position of the upper rail relative to lower rail, so that motion of the upper rail relative to the lower rail produces a corresponding tilt of the armrest support.

18 Claims, 13 Drawing Sheets

COMPOUND LEVER AND ARMREST MOUNTING ASSEMBLIES

REFERENCE TO RELATED APPLICATIONS

This application is a continuation of my application having Ser. No. 09/004,379, filed Jan. 8, 1998, now abandoned, and incorporates my U.S. Pat. No. 5,542,746 issued Aug. 6, 1996, by reference.

BACKGROUND

A) Field of Invention

The present invention relates to a variable posture work chair with a displaceable armrest assembly which maintains a constant user defined spatial relationship to a moveable seat pan and backrest.

B) Known Art

The proliferation of computer terminals at the modern workstation has spawned a variety of attempts to provide a more comfortable environment for seated workers. The general discomfort that afflicts the legs, lower back, neck, shoulders and wrists of seated workers can be partially offset by building better seating devices, particularly those that conveniently allow a wide range of posture changes. An in depth discussion of the advantages and disadvantages of various seating designs is contained in my previous patent.

The builders of work chairs face several key challenges in effecting their designs. Among the most important:

Comfort and utility. A work chair must be adaptable to a wide range of work place requirements while maintaining ergonomically correct comfort for a seated user.

Ease of use. A seated user should be able to transition smoothly from one position to another with a minimum of mechanical intervention. The most efficient way of achieving this is by building a chair mechanism that effects its changes through a controllable rocking movement.

Adjustability. A single design platform should be able to accommodate a wide range of human body sizes while easily adapting to the changing needs of the workplace.

Integration of components and their movements. Interconnecting a moveable seat pan, backrest and armrest assembly so that they function in a synergistic fashion while effecting utilitarian variable posture remains a key focus of invention in the field of work chair design.

Engineering and production costs. A design must be relatively simple to engineer and cost effective to build, or it stands no chance of succeeding in the marketplace.

In addition much design emphasis is now being placed on the aforementioned term "variable posture", and while the term is important in the ergonomic sense it lacks any mechanical definition. A simple way to measure the degree of variable posture in any chair design is to assess the useable range of seat pan tilt the design provides. The greater the range of useable tilt (up to a maximum) the greater the shift in body footprint and center of gravity, this being variable posture. By "useable" is here meant that a seated user should be able to tilt the seat pan to a chosen inclination/declination from the horizontal, lock that inclination/declination in place and work comfortably from that position for extended periods of time. Obviously, for this scenario to succeed the other elements of the chair design must function in harmony with the movement of the seat pan.

A detailed discussion of the variable posture issue and several relevant patented designs is contained in my aforementioned patent. Further, U.S. Pat. Nos. 5,577,802 to Cowan and Kmicikiewicz and 5,540,481 to Roossien et al show chair designs which attempt to effect easy adaptation to the movements of a seated user. While Cowan shows armrests they are not crucial to the central design; for Roosien et al the armrests are superfluous. U.S. Pat. No. 5,536,070 to Lemmen shows an ergonomic armrest assembly but attempts no real integration with the seat pan and backrest. U.S. Pat. No. 4,277,102 to Aaras et al describes a chair with individually supported armrests. Various armrest assemblies are described in U.S. Pat. Nos. 5,439,267 to Peterson et al, 5,407,249 to Bonutti, 5,393,124 to Neil, 5,380,065 to Rohrer, 5,369,805 to Bergsten et al, 5,366,276 to Hobson et al, 5,215,282 to Bonutti, 5,056,863 to DeKraker et al, 5,009,467 to McCoy, and 4,887,866 to Rusin.

Several observations come to light when examining the prior art in this field. First, and in general, when chair designers attempt to build a relationship between a seat pan and a backrest they fail to adequately integrate armrest assemblies into their designs. Even when the appearance of attention to detail is given, armrest assemblies are usually dispensable add-ons to the basic chair assembly. Conversely, the designers of armrest assemblies show little interest in integrating the functions of their designs with the movements of a variable posture seat pan and backrest. Armrests, whether built individually or interconnected on a frame, are designed to be added onto, and not integrated into, a pre-existing chair.

More specifically, current design practice almost always fixedly attaches armrest assemblies to a tiltable seat pan or its mount without adequately separating and then integrating the functions of the two assemblies. If one posits that the chief a function of a work chair armrest assembly is to align a user's forearms with a keyboard or other work surface it can be seen that this alignment is constantly being upset by the movements of the seat pan to which it is locked, movements which are necessary to effect variable posture. Further, if one attempts to lock the armrests into an aligned position the seat pan can only follow, thus affording a position which may not be the most comfortable for the user's needs.

It is to the aforementioned issues that the substance of the current invention is therefore addressed.

Objects and Advantages

The objects and advantages of my previous patent are incorporated into the present invention.

Further, it is the general objective of the present invention to provide a variable posture chair assembly that integrates and synchronizes the functions and movements of a seat pan, a backrest, two armrests and, optionally, a leg-rest for a seated user. The chair will be adaptable to a wide variety of workplace requirements, comfortable in all positions, easy to use, adjust to varying body sizes and be relatively simple and cost effective to build.

Specifically

A significant advantage of the present invention is its implementation of a compound lever mounting assembly to effect a differential in tilt among an armrest assembly, a seat pan and a backrest. A seated user will enjoy several key benefits by effecting this differential tilt. Chief among these is the ability to vary the angle of the seat pan and backrest to the maximum practical extent while simultaneously keeping the armrests, and thus the forearms, aligned with a work surface such as a keyboard. Only a rocking motion and operation of a braking assembly are necessary to effect basic changes in alignment. Simple controls allow further manual adjustments that remain part of the configuration.

The compound lever mounting assembly consists in part of two upper and two lower side rails that act as two levers mounted to a central dual fulcrum. Other elements of the chair are a seat pan assembly, a backrest assembly, an armrest assembly and an appropriate base. Elements may be linked to one or both of the levers. The key functions of the assembly are summed up as follows and are detailed later in the specification:

Two upper and two lower side rails are connected by a plurality of axes so that the four tilt in tandem as one upper and one lower lever. The levers are mounted to a dual fulcrum positioned near their center; the fulcrum may be moved to the forward end of the lever assembly. A seat pan assembly is attached to one end of the lever assembly and the armrest and backrest assemblies are attached to the other. The lever assembly may rock freely or be locked down; its total range of tilt is herein referred to as "tilt range".

The dual axles of the seat pan mount are connected to the forward end of the compound lever so that the axles share the same constant vertical axis as that of the non-moving central dual fulcrum. The seat pan itself is hinged to the upper of the two axles and is loaded by a spring at a constant forward inclination that changes only when counter loaded by a seated user. The maximum range of seat pan tilt is herein shown to be 33–40 degrees. A forward stop and the available rearward tilt of the compound lever assembly limit this range. It is anticipated that most users of the chair will find approximately 18 degrees of loaded seat pan tilt and 15 degrees of free tilt to be adequate for daily use.

The armrest assembly is also referenced by the two levers to the non-moving vertical axis of the central dual fulcrum. The vertical axis of the armrest assembly mount may be referenced in the same fashion as that of the seat pan or it may be offset. offsetting the mount is the preferred embodiment of the present invention. The degree of armrest assembly fore-aft tilt created by the interaction of its mount with the compound lever is herein referred to as "linked tilt range". This range will be shown to be variable depending upon the method of mounting the armrest assembly to the lever assembly. The fore-aft tilt of the armrest assembly may also be manually adjusted, herein referred to as "positional displacement".

The adjustable backrest assembly is referenced to the upper of the two levers only. It tilts in tandem with a single, not a dual lever. Thus the variable movements of the backrest are synchronized with the tilt of the loaded seat pan.

The difference in the default range of tilt between the lever assembly and the armrest assembly is determined by subtracting the linked tilt range from the tilt range. The difference is herein referred to as "differential tilt". The differential tilt of the assembly is determined by the method of attaching the armrest assembly to the compound levers and the degree of tilt range.

This assembly allows a seated user to precisely align his or her forearms with a keyboard or other work surface while simultaneously adjusting the angle of the seat pan and lock that alignment into position. Necessary height compensations can be achieved through central chair height adjustment, the armrests themselves or the use of a detached adjustable keyboard desk. If a desk assembly is mounted directly to the armrest assembly no height compensation is needed. Further, a user may set the horizontal tilt of the armrest assembly to satisfy a specific need; this preset (positional displacement) determines a resulting default range of armrest movement. If the user locks the mounting assembly into a specific position the armrests remain at a solidly fixed position while the user enters into and exits from the chair and the seat pan continues to tilt over its available range of movement. This facilitates entering into or exiting from a seated position, particularly one of reclining. The user can also effect a rocking and stretching motion consistent with variable posture, this because the seat pan and backrest are pivotally fixed to their mounts.

A further significant advantage of the present invention is the use of a single integrated armrest assembly to be used in conjunction with a seat pan, a backrest, and, optionally, a leg-rest. This assembly has the following advantages:

It synchronizes easy user effected lateral adjustment of two armrests from a single control, thereby accommodating a wide range of shoulder widths.

It synchronizes easy user effected fore and aft tilt of two armrests from a single control by mounting the assembly so that it pivots controllably on its long axis within the mounting frame.

It allows for simple height and horizontal adjustment of the armrests.

It is relatively easy to engineer and cost effective to build.

The advantages of using a keyboard desk or an abdominal rest when attached to an armrest assembly were thoroughly covered in my previous patent. The present design incorporates these advantages and facilitates the use of these accessories by providing for easy mounting to and removal from the assembly.

Further objects and advantages of the present invention will become apparent from a consideration of the drawings and ensuing description.

BRIEF DESCRIPTION OF ENCLOSED DRAWINGS

Figure 4:
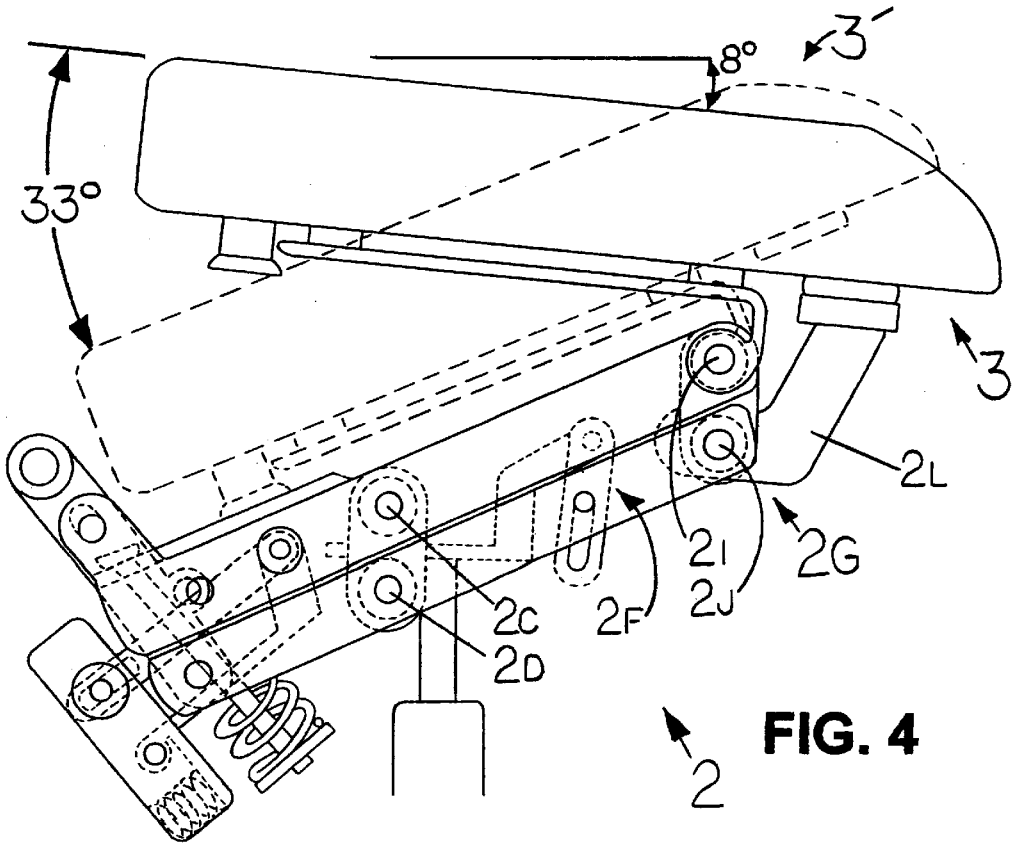

FIG. 4 shows the compound lever assembly and seat pan in profile with the lever assembly at an angle of approximately 25 degrees rearward tilt. The maximum range of movement of the seat pan from a constant fully unloaded position of approximately 8 degrees forward tilt to a fully loaded position of about 25 degrees rearward tilt (here 33 degrees) is also shown.

FIGS. 5–5*a* through 10–10*a* show some possible pivot mounting combinations for an armrest bracket mounted to the rear of the dual compound lever assembly. The tilt range, linked tilt range, and differential tilt for each configuration is given (see discussion below).

Figure 11A:
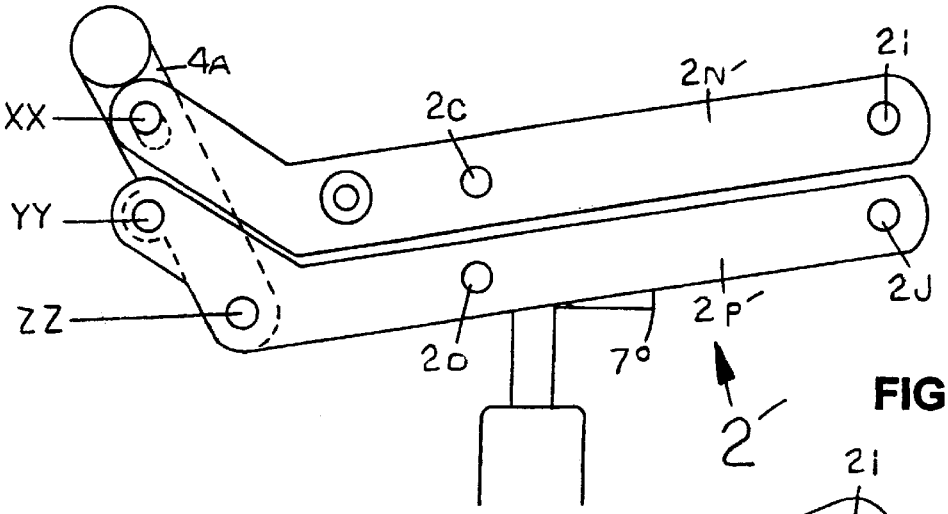
Figure 11B:
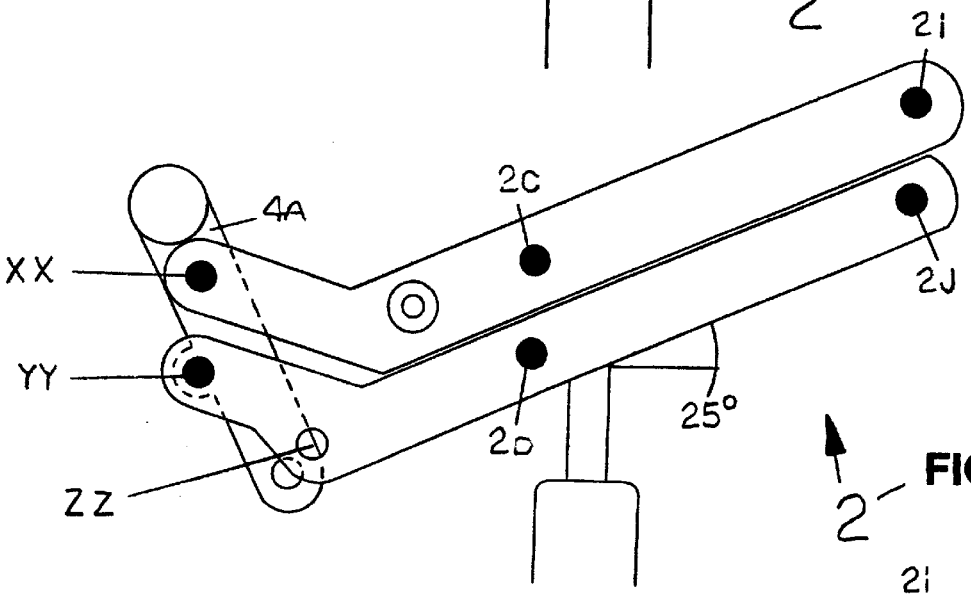
Figure 11C:
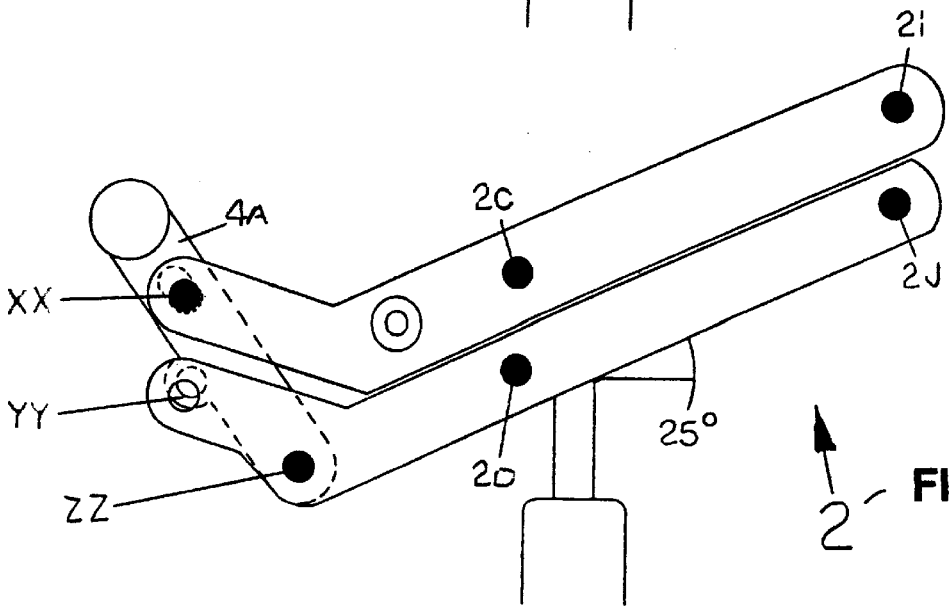

FIG. 11*a*–11*c* show an alternative embodiment of the compound lever assembly.

Figure 12:
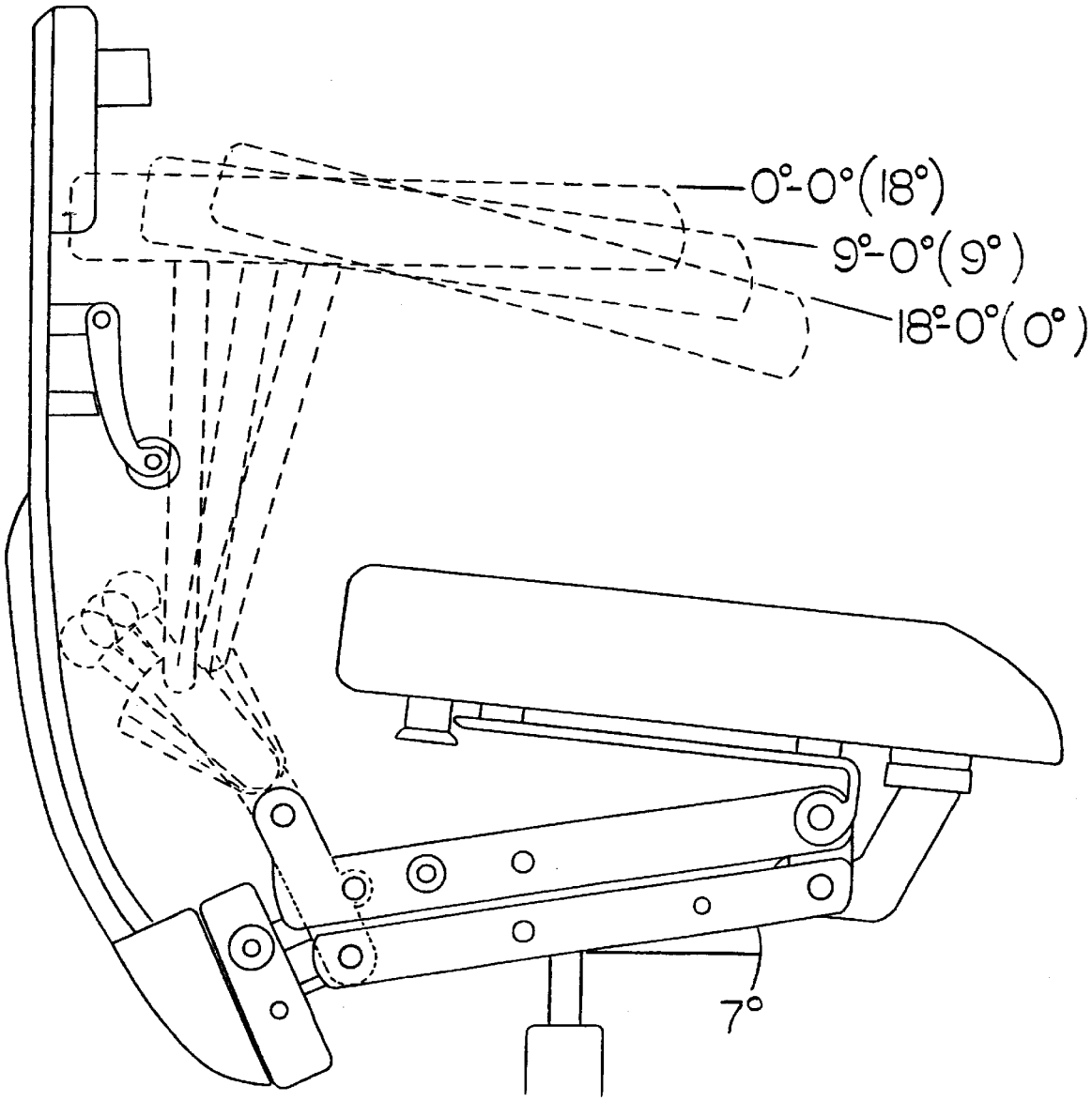

FIG. 12 shows a relational summary of the linked tilt ranges and differential tilts created by the interaction of assemblies 2 and 4 as shown in FIGS. 5–11*c*.

Figure 13:
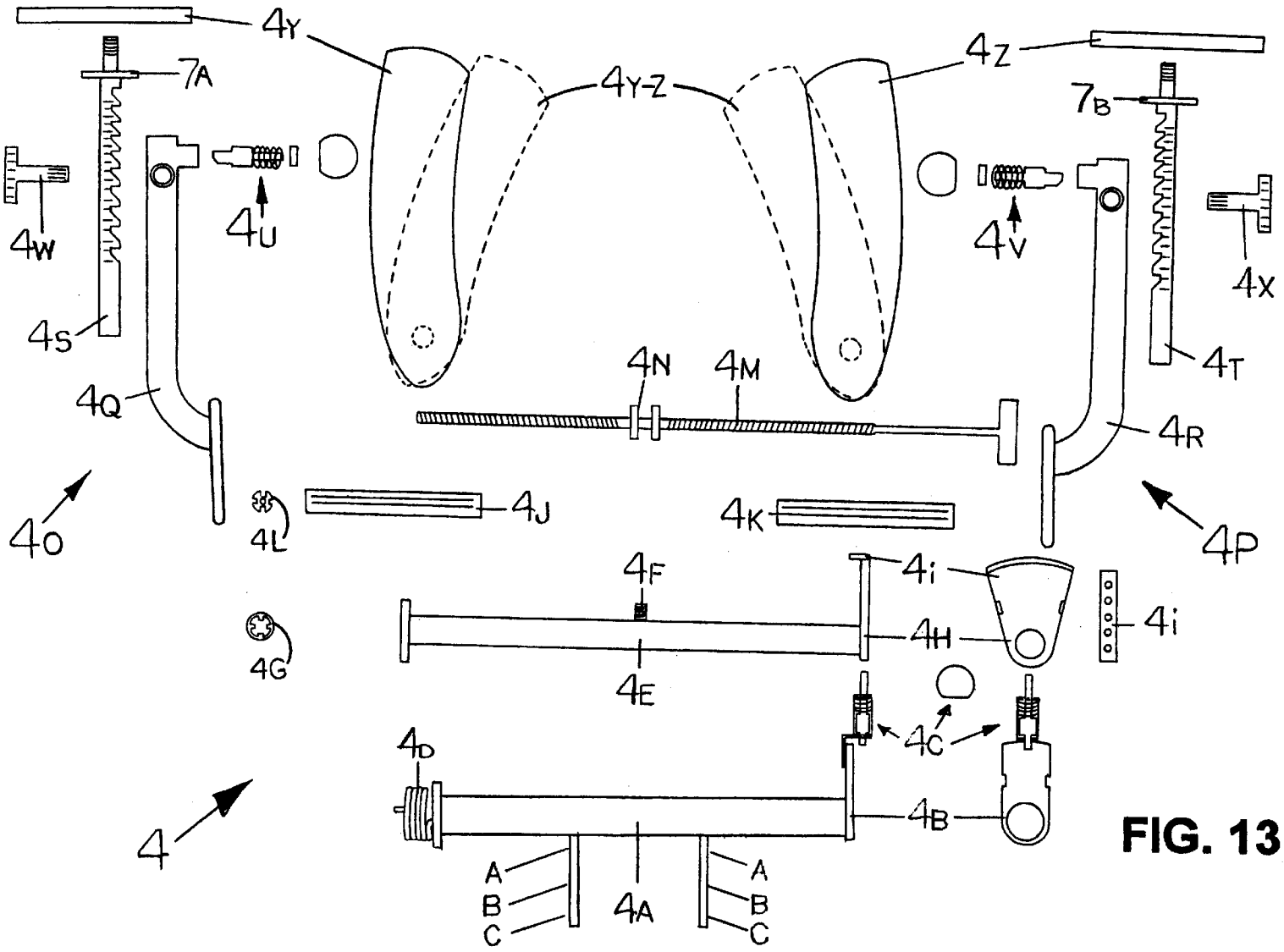

FIG. 13 shows an exploded view of a possible construction of the armrest assembly.

Figure 14:
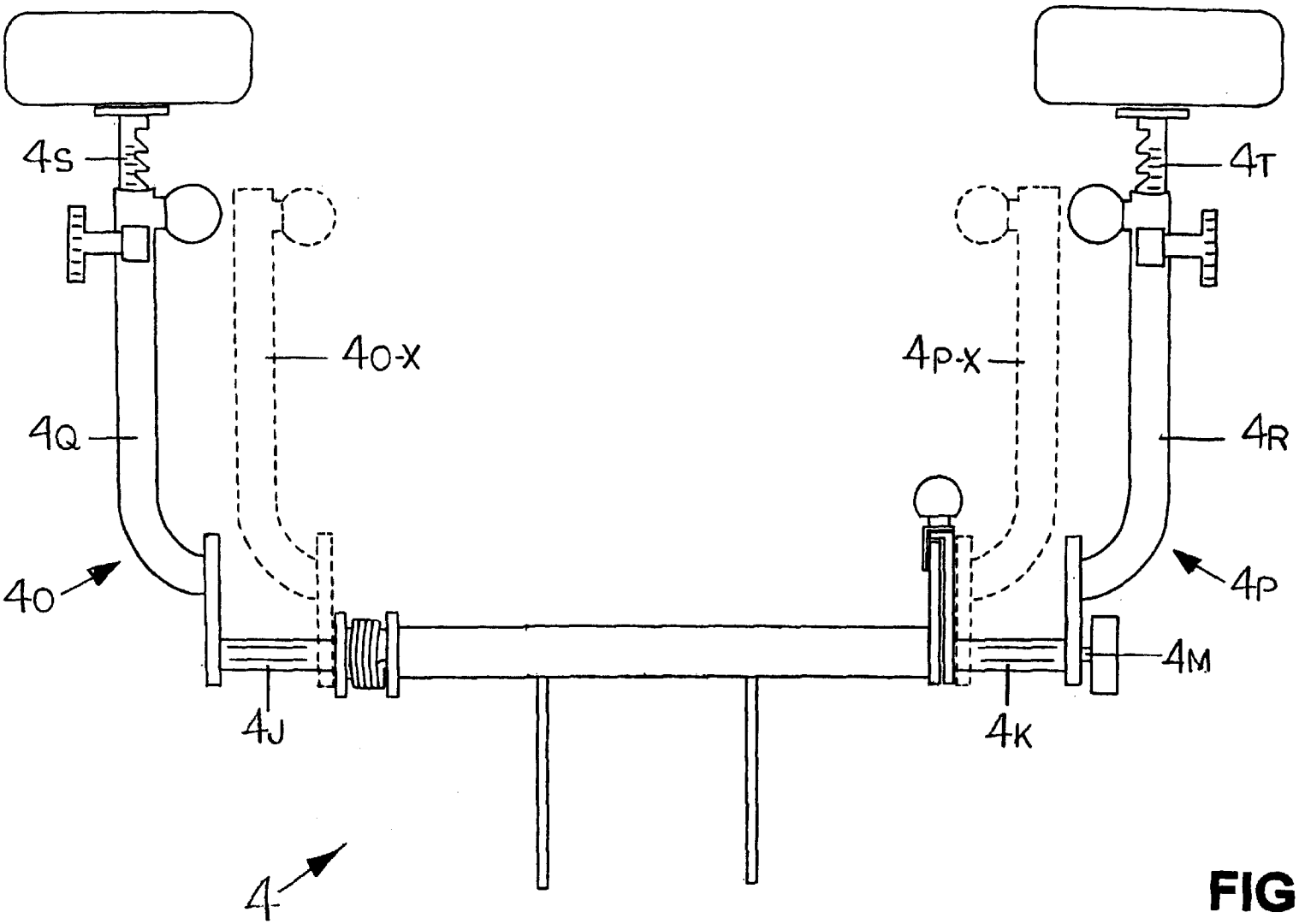

FIG. 14 shows the lateral movements of the armrest assembly.

Figure 15:
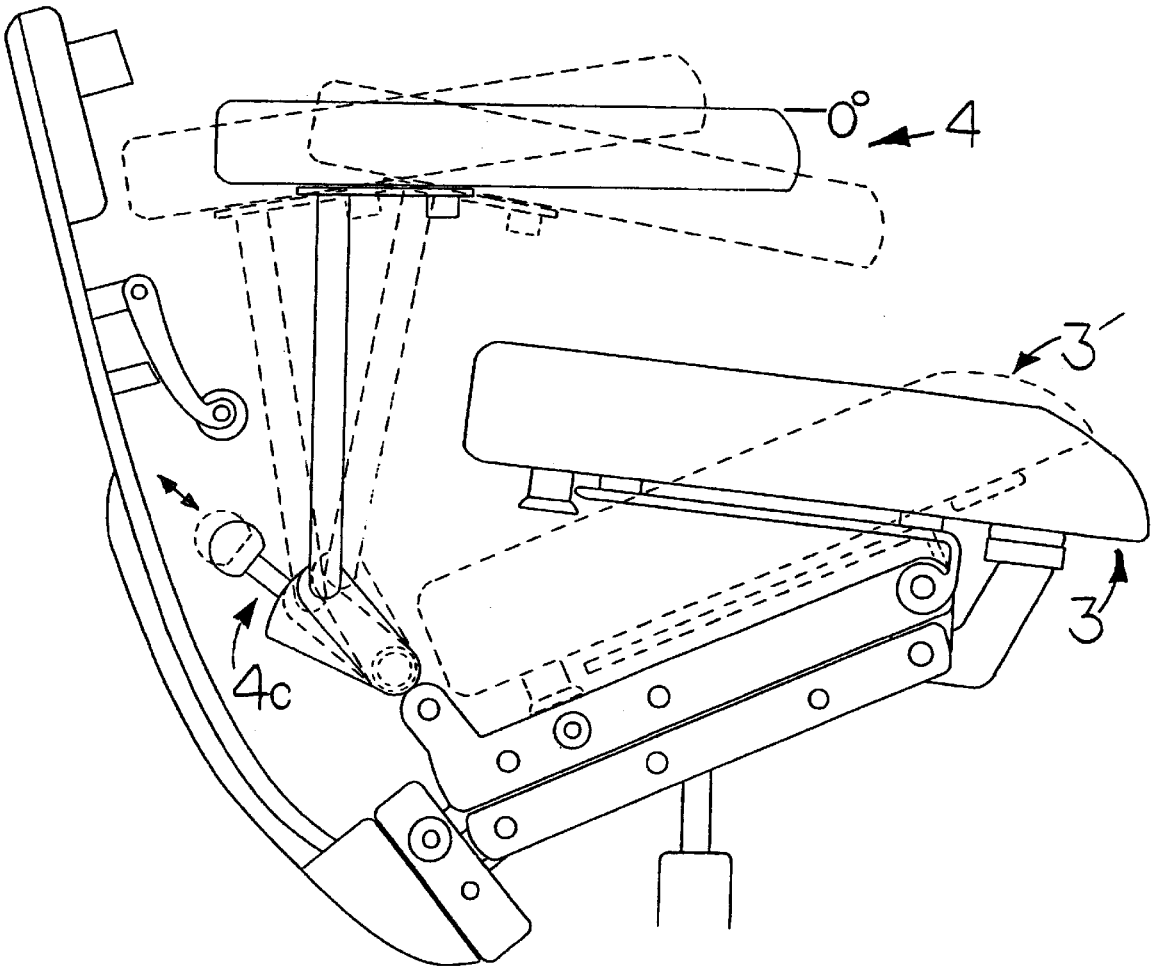

FIG. 15 shows the user definable positional displacement of the armrest assembly and reiterates the range of possible movement of the seat pan.

Figure 16:
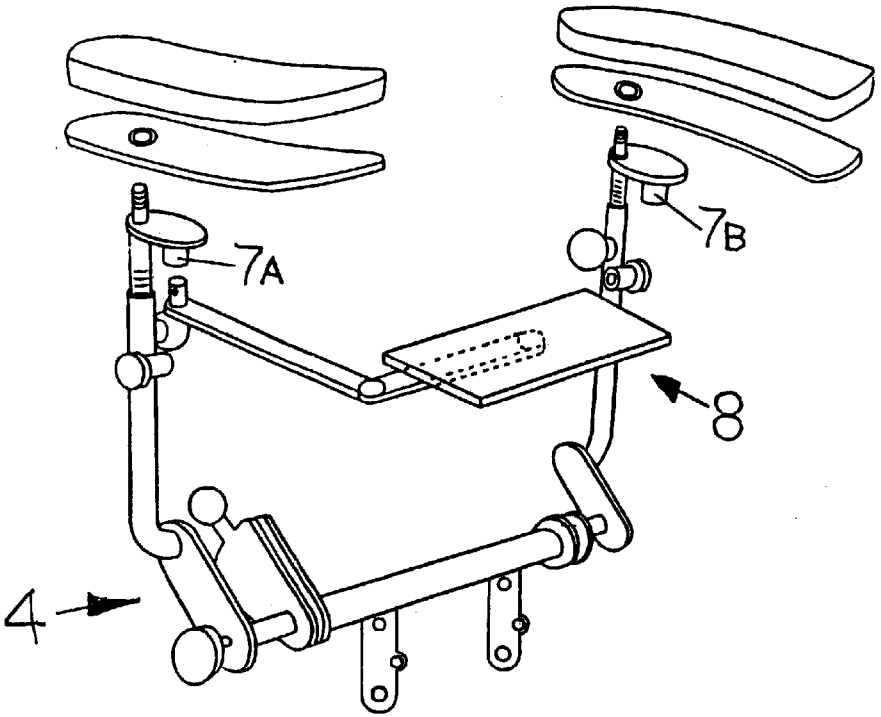

FIG. 16 shows a keyboard or other desk attaching to the assembly.

Figure 17:
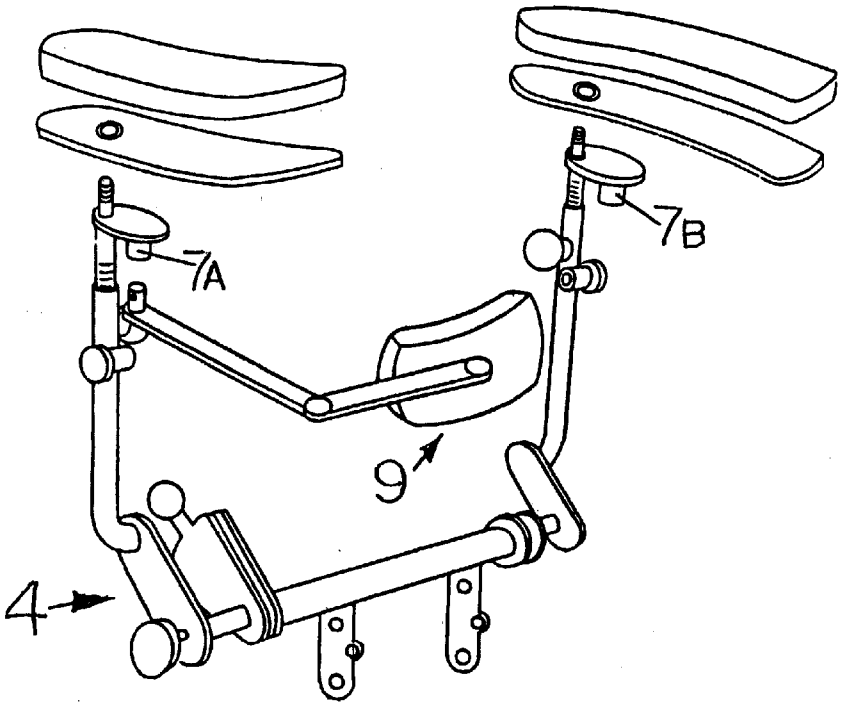

FIG. 17 shows an abdominal rest attaching to the assembly.

Figure 18:
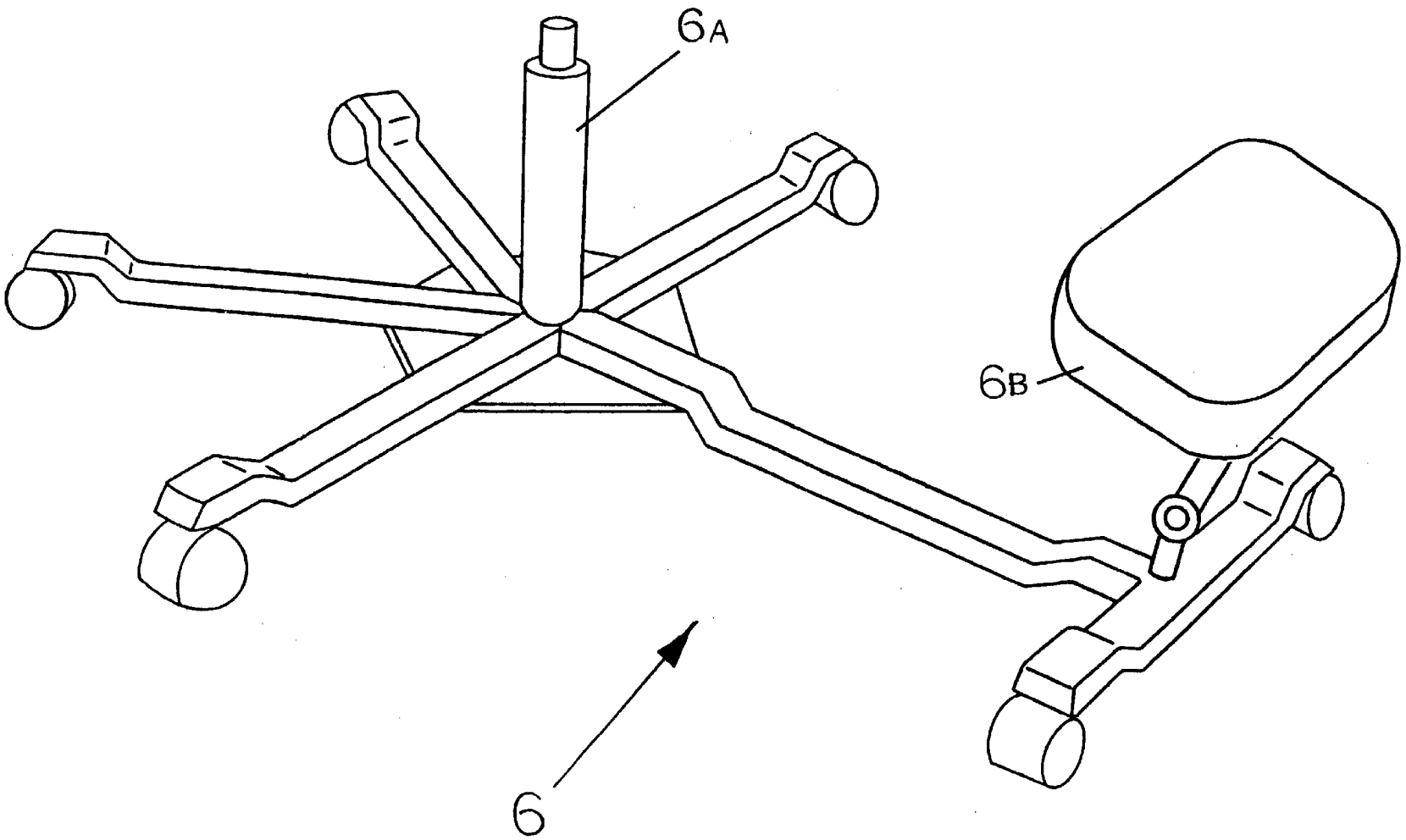

FIG. 18 shows a possible base assembly for the invention.

DETAILED DESCRIPTION OF EXEMPLAR EMBODIMENTS

The design advantages and practical use of a variable posture chair that might be called a synergistic hybrid were thoroughly expounded upon in my previous patent; those advantages and general methods of use are incorporated into the present text. In addition, the user of the present invention will enjoy the synchronized movements of a seat pan, backrest and two armrests in an assembly that allows for maximum ease of use and maximum control over the positioning of the armrests relative to a work surface.

Figure 1:
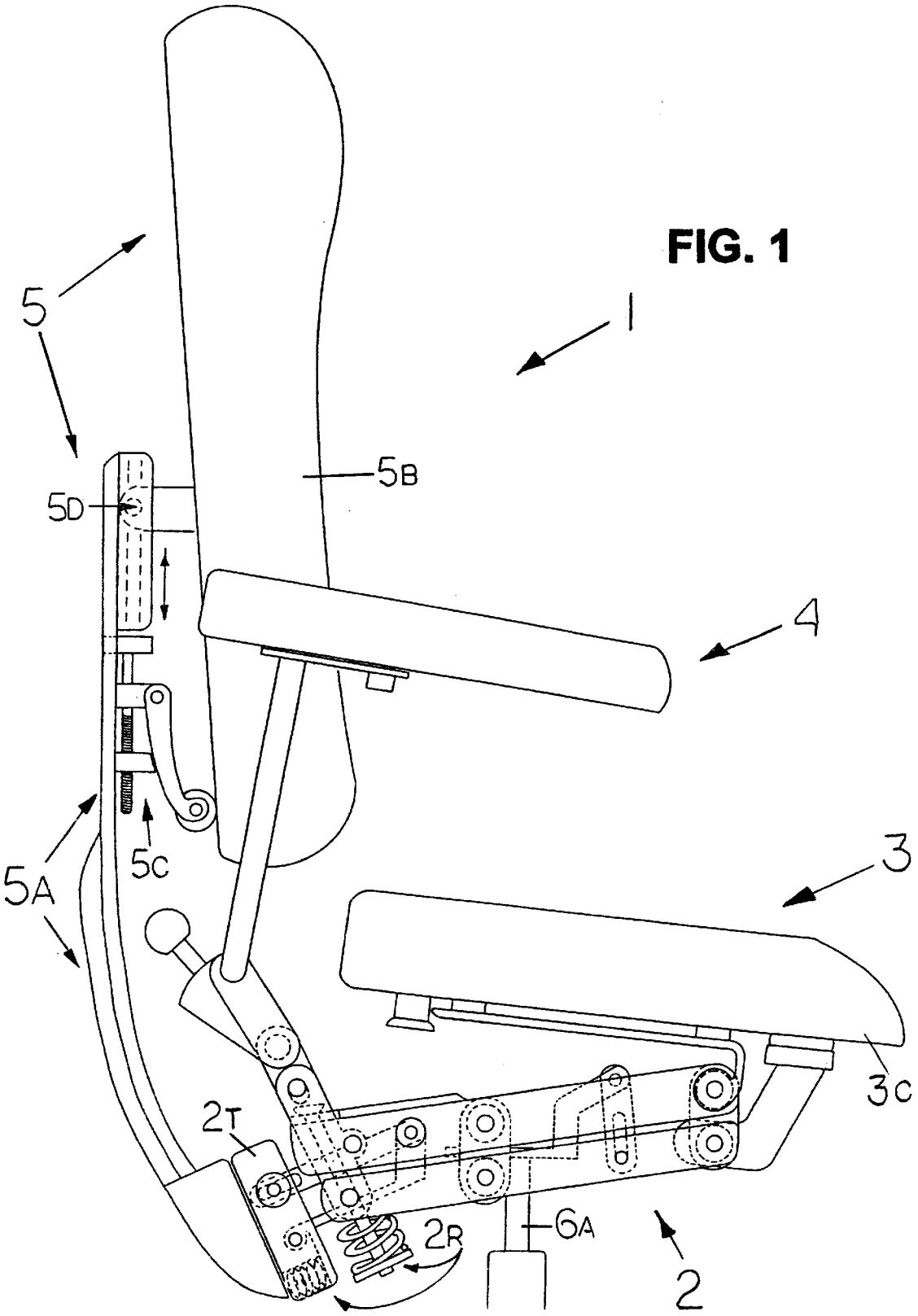
FIG. 1 shows a profile of the major elements of the preferred embodiment of the present invention, minus a base. The main elements of the backrest assembly are detailed.

FIG. 1 shows the preferred embodiment of the present assembly in an unloaded position. A chair assembly 1 comprising a compound lever assembly 2, a seat pan assembly 3, an armrest assembly 4 and a backrest assembly 5 is mounted to an appropriate base assembly 6 (see FIG. 18) and upright stem 6*a*. Backrest assembly 5 consists of a vertically adjustable backrest upright assembly 5A which mounts to backrest mount assembly 2R at coupler housing 2*t* (see FIG. 2), a backrest cushion 5*b*, a wedge and pivot assembly 5C and a vertically moveable cushion pivot assembly at 5D.

Figure 2:
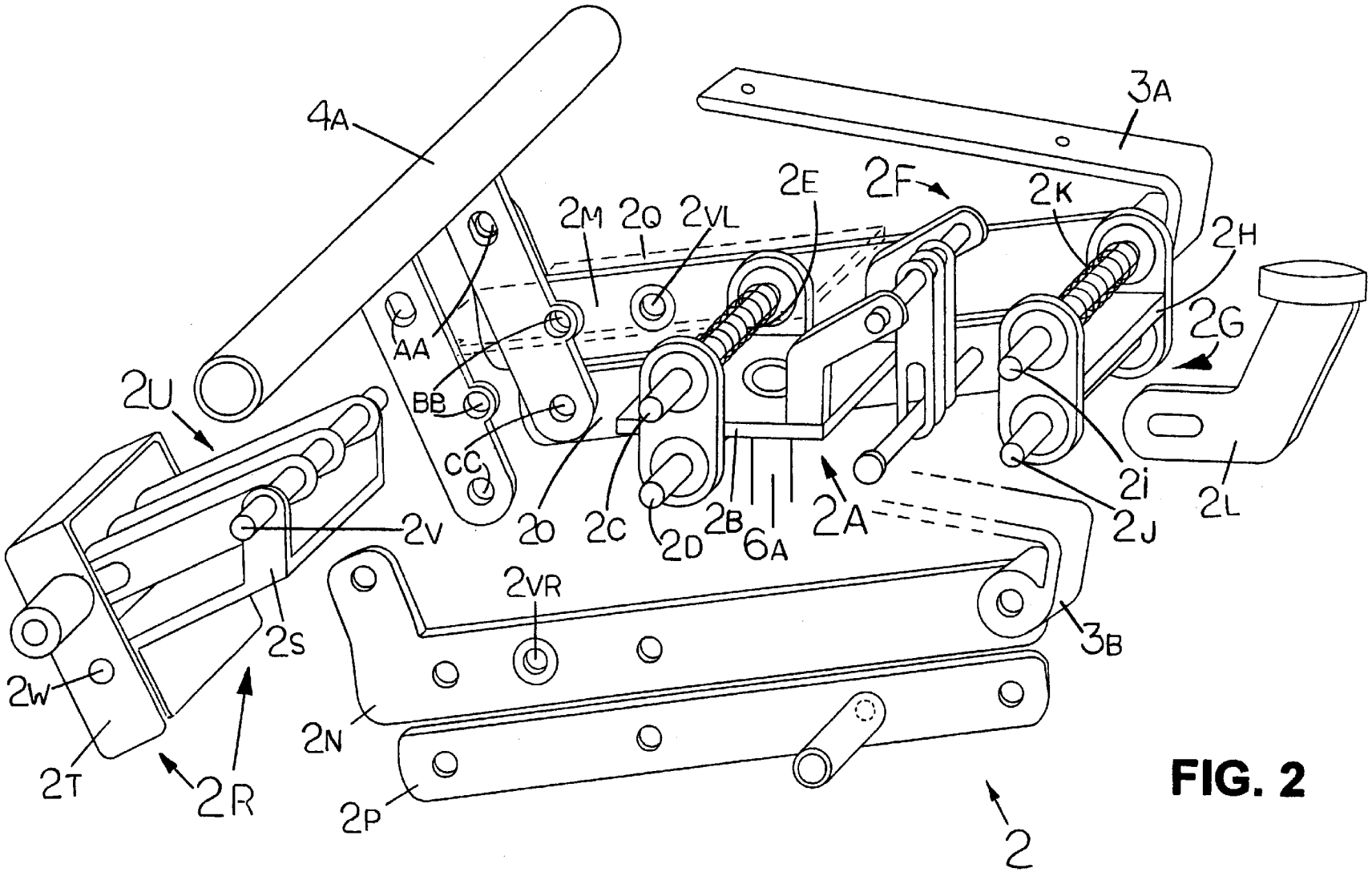
FIG. 2 shows the main components of the compound lever assembly in cutaway.

FIG. 2 shows the major components of compound lever assembly 2. A main mounting assembly 2*a* comprises a mounting plate 2*b*, an upper main axle 2*c*, a lower main axle 2*d*, a main return spring 2*e* and a tilt lock assembly 2*f* (such as a spring and clutch plate brake of known design). A front axle assembly 2*g* comprises a front axle mount 2*h*, an upper front axle 2*i*, a lower front axle 2*j*, a seat pan return spring 2*k* and a seat pan stop 21. An upper left side rail 2*m*, an upper right side rail 2*n*, a lower left side rail 2*o* and a lower right side rail 2*p* mount onto axles 2*c*, 2*d*, 2I and 2*j*. A top plate 2*q* (also FIGS. 3 and 4) binds upper rails 2*m* and 2*n* together and serves as one point of mounting for backrest mount assembly 2*r* (see FIGS. 1, 3 and 4). Assembly 2*r* comprises a mounting plate 2*s*, a coupler housing 2*t*, a braking assembly 2*u* (preferably a spring and clutch brake of known design), a mounting axle 2*v*, a tilt axle 2*w*, tilt adjust springs 2*x* (see FIGS. 1, 3 and 4), a main spring shaft 2*y* and a main return spring 2*z* (see FIGS. 1, 3 and 4). Assembly 2*r* mounts by means of axle 2*v* at left bearing 2*vl* and right bearing 2*vr*. Seat pan mount L 3*a* and seat pan mount R 3*b* mount to axle 2I on either side of assembly 2. Seat pan cushion 3*c* mounts to 3*a* and 3*b* (see FIGS. 1, 3 and 4). Main armrest assembly housing 4*a* mounts by means of a combination of pivot pairs AA, BB and CC to rails 2*m*, 2*n*, 2*o* and 2*p*.

Figure 3:
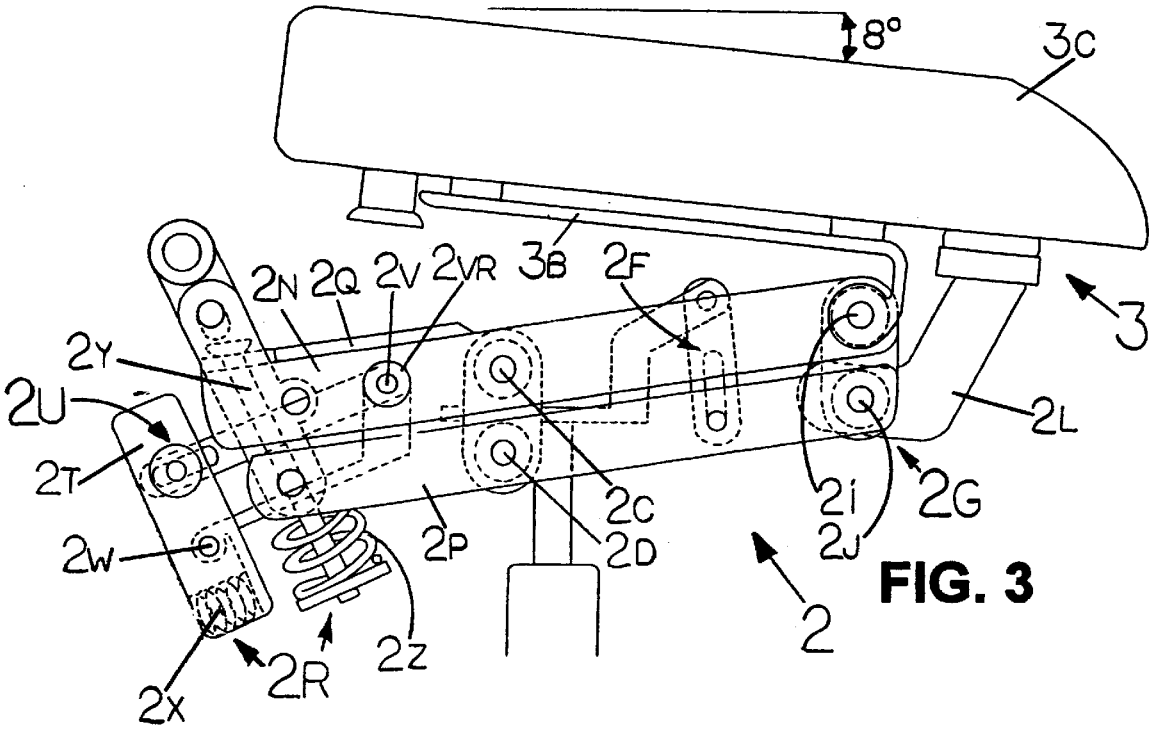
FIG. 3 shows the compound lever assembly and seat pan in profile with the lever assembly at an angle of approximately 7 degrees rearward tilt and the seat pan at approximately 8 degrees forward tilt.

FIG. 3 shows the main components of assembly 2 in a position of approximately 7 degrees rearward tilt or, conversely, its maximum forward tilt. The assembly is forced into this position by the counter load of spring 2*e*, mounted on axle 2*c* (see FIG. 2). The minimum and maximum angles of the assembly are determined by the range of tilt lock assembly 2*f*, preferably a spring and clutch plate brake of known design. Tilt lock 2*f* can lock assembly 2 down at any position over its tilt range, or it can be disengaged to allow assembly 2 to act as a rocker. Seat pan cushion 3*c* is mounted to 3*a* and 3*b*; the assembly 3 is mounted to axle assembly 2*g*. Return spring 2*k*, mounted on axle 2I (see FIG. 2), keeps assembly 3 in a constant unloaded position of approximately 8 degrees forward tilt limited by seat pan stop 21. Variations in the forward tilt of assembly 3 can be achieved by making the seat pan stop 21 adjustable or changing its manufacture. Backrest mount assembly 2*r* is mounted by means of axle 2*v* to upper side rails 2*m* and 2*n* and spring shaft 2*y* through top plate 2*q*. Thus it is apparent that assembly 2*r* is referenced to only the upper of the two levers of assembly 2; unlike the seat pan and armrest assemblies its basic movements are tied to a single, not a compound lever. The inclination of coupler housing 2*t*, to which back rest assembly 5 is attached, is determined by the range of braking assembly 2*u*, preferably a spring and clutch plate brake of known design. As the brake is released interior springs 2*x* force the assembly to tilt forward and into the back of a seated user, who then counter forces with his or her weight until the desired angle is achieved and the brake locked down. Once in the chair a user effects some backrest rocking motion by forcing the assembly against main return spring 2*z*.

FIG. 4 shows assembly 2 in a position of maximum rearward tilt of approximately 25 degrees. A tilt range for assembly 2 of about 18 degrees is thus established. The position is limited and can be locked by tilt lock 2*f*. The full possible range of motion of seat pan assembly 3 (3–3') is also shown. From a forward position of approximately 8 degrees the seat pan can travel to a potential maximum rearward tilt of 25 degrees, a range in this case of 33 degrees. This range of travel could be extended by either altering the limit of tilt lock 2*f* or altering the limit of seat pan stop 21; it is unlikely that the maximum useable range would exceed 40 degrees. Seat pan position 3 represents an assembly 2 that is locked down and unloaded. Position 3' represents an assembly 2 that is under load and may or may not be locked down. Note that while the angle of inclination of the compound lever has changed by approximately 18 degrees from the 7 degrees of FIG. 3 the angle of the unloaded seat pan at position 3 has remained constant at 8 degrees forward tilt. This is because the vertical positions of axles 2I and 2*j* are referenced by parallel levers to the fixed vertical positions of axles 2*c* and 2*d*. The relative positions of the two identical (equal and parallel) sets of axles can always be illustrated as a parallelogram. As the levers tilt in tandem from the fixed vertical positions of fulcrum axles 2*c* and 2*d* the identical vertical axis of axles 2I and 2*j* will be held constant.

An additional on/off stop for the seat pan (not shown) may be added to the present configuration. The stop would be designed to keep the forward tilt of the seat pan in place. The connection would be made between mounts 3*a*–3*b* and either the axle of tilt lock 2*f* or an auxiliary axle mounted to the upper lever of assembly 2 (2*m* and 2*n*). This would allow a seated worker to lean forward and into his or her work with forward seat pan support and would make the use of an abdominal rest easier.

Before examining the linkages illustrated in FIGS. 5–11*c* some terms need to be repeated. First, the use of numbers and degrees herein is intended to be approximate and has been rounded out for the sake of clarity. "Tilt range" refers to the range of tilt of compound lever assembly 2, here 18 degrees. "Linked tilt range" refers to the range of armrest tilt afforded by the mount of assembly 4 to assembly 2. "Differential tilt" is the difference in tilt between the lever assembly's tilt range and the armrest assembly's linked tilt range; it is determined by subtracting the linked tilt range from the tilt range for a given configuration. "Positional displacement" refers to the manual change in fore-aft position a user may effect on the arm rest assembly (see FIG. 15 et al). A change in positional displacement will not affect the linked tilt range or the differential tilt.

There are numerous ways to mount a seat pan, a backrest, and an armrest assembly to a compound lever in order to effect a differential in tilt among the components. Three different methods of fastening the pivot mount of an armrest assembly to a compound lever are illustrated in FIGS. 5–5*a* through 10–10*a*; the seat pan and backrest mounts do not change. FIGS. 11*a*–11*c* show an alternative embodiment. In each set of drawings assembly 2 is shown both at 7 and 25 degrees rearward tilt, a tilt range of 18 degrees. The "a" series of drawings 5 through 10 are enlarged views of the three possible mounting combinations of housing 4*a* to the upper and lower side rails 2*m*, 2*n*, 2*o*, and 2*p*. The dual letters AA, BB and CC designate a mount to both left and right side rails (see FIG. 2).

In FIGS. 5–5*a* and 6–6*a* the linked tilt range of the armrest assembly is 0 degrees and the differential tilt is 18 degrees. (18 degrees −0=18). There is no change in the vertical or horizontal tilt of assembly 4 as lever assembly 2 effects a tilt range of 18 degrees from FIG. 5 to FIG. 6. Here pivot pairs BB–CC, 2I–2*j* and fixed fulcrum pair 2*c*–2*d* are parallel and equal, thus forming the corners of one or two parallelograms. Pivot AA is unattached. The three pairs of pivots maintain identical vertical axes as assembly 2 tilts over its range of movement. Since armrest assembly 4 responds to the tilt of assembly 2 with a mostly vertical movement a seated user would experience armrest pads that maintain a constant user defined horizontal inclination (note positional displacement and see FIG. 15), no matter what the angle of assembly 2.

The illustrated movement of assembly 4 is not strictly vertical. Pivot pairs BB–CC and 2I–2*j* travel on the arc of a circle relative to fulcrum pair 2*c*–2*d*; thus the horizontal distance between the vertical axes of BB–CC, 2*c*–2*d* and 2I–2*j* fluctuates as the pivot pairs reach the upper and lower positions of their arc. This can be seen by the offset in positions of unfixed pivot AA holes from FIG. 5–5*a* to 6–6*a*, and by measuring the distance between the vertical axes of BB–CC and 2I–2*l* on FIG. 5 and FIG. 6. Because pivots BB–CC begin their transit below the horizontal axis of fulcrum 2*c*–2*d* they move downward and inward on their arc as assembly 2 tilts rearward. Thus an attached arm rest assembly would move down and slightly forward while a seated user is positioning him or herself rearward, creating a potential alignment problem between the forearm and armrest pad. The problem can be corrected for this configuration by offsetting the levers and moving pivots BB and CC upward on the arc referenced from the assembly fulcrum (see FIGS. 11*a*–11*c*).

FIGS. 7–7*a* and 8–8*a* illustrate the preferred embodiment of the present invention. Here the linked tilt range of the armrest assembly is 9 degrees and the differential tilt is 9 degrees. (18 degrees−9=9). Thus the differential tilt for this configuration is about half that of FIGS. 5–6*a*. Here pivots AA–CC, 2*c*–2*d* and 2I–2*l* are connected on upper and lower side rails 2*m*, 2*n*, 2*o* and 2*p*. Pivot BB is not connected. Pivot pairs 2*c*–2*d* and 2I–2*l*, which are parallel and equal, now define the four corners of a parallelogram and maintain identical vertical axes. The third (now offset) vertical axis formed by pivots AA and CC is of an arbitrary inclination. Pivot AA has been referenced to the armrest housing 4*a* so that a constant spatial relationship is maintained between 4*a* and the seat pan 3 at axle 2I (also see FIGS. 6–6*a*). While all aforementioned pivots have been circular because they need only rotate on the axes of a parallelogram, offset pivot AA must be able to move within a slot. If it were circular it would be a lock on the assembly due to its offset position. The length of slot AA in fact limits the tilt of assembly 2 (also limited by tilt lock 2*f*).

Pivot AA transits an arc that is referenced to and begins above the horizontal of the fulcrum at 2*c*. AA arcs downward and outward across the horizontal. AA is referenced to pivot CC, which is transiting downward and inward on the lower portion of a smaller arc referenced to 2*d*. These two intersecting and interconnected arcs restrict the linked tilt range of armrest assembly 4 to about half the tilt range of lever assembly 2 to which it is connected. Thus a seated user can employ a simple rocking motion to effect a change in tilt at the (loaded) seat pan of 18 degrees and a simultaneous change in tilt at the armrests of roughly half that, about 9 degrees. The user may effect a positional displacement of the armrests at any time (see FIG. 15).

Figure 5:
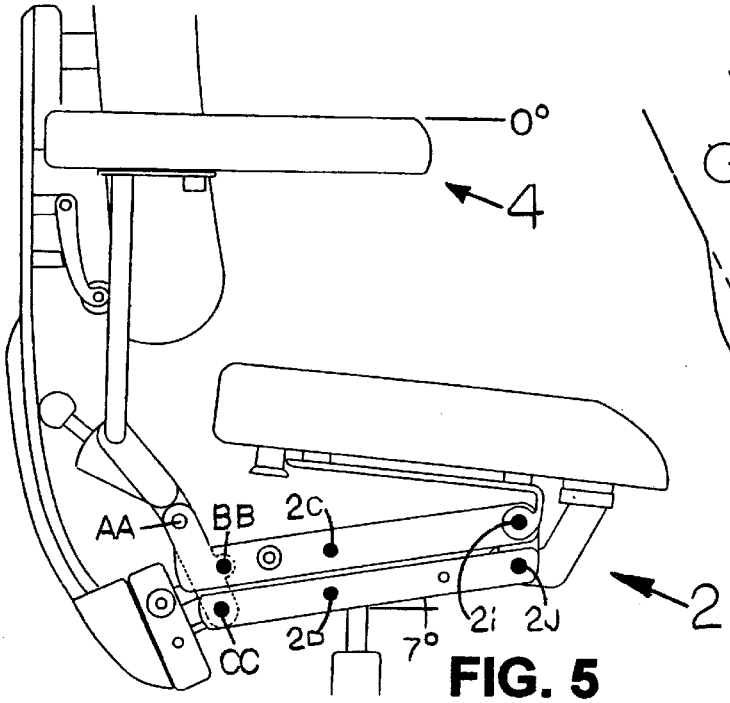
Figure 5A:
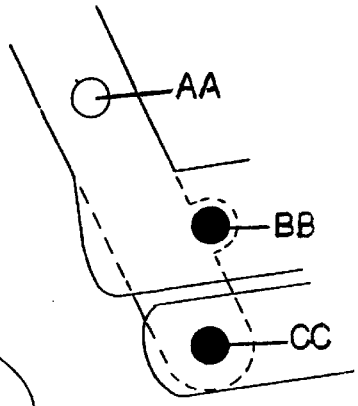
Figure 6:
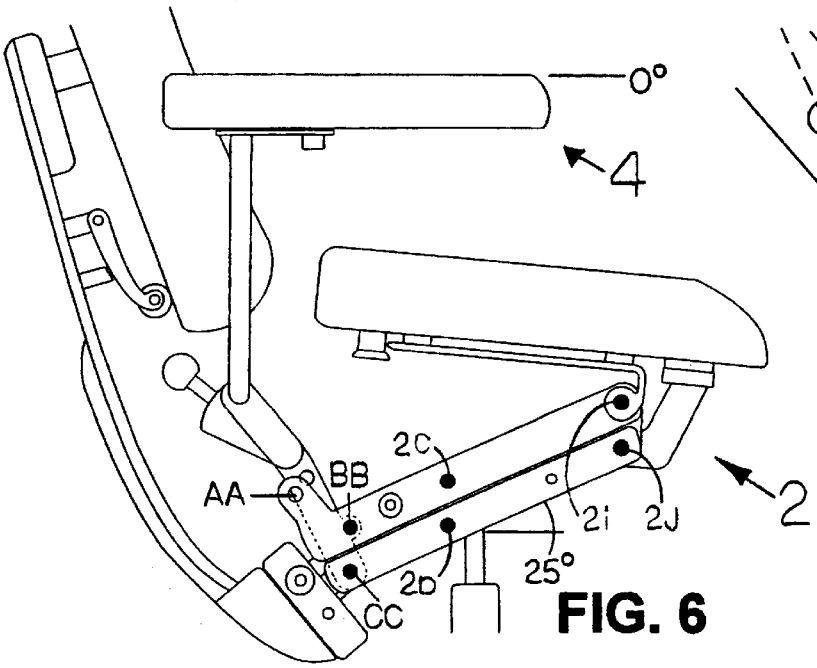
Figure 6A:
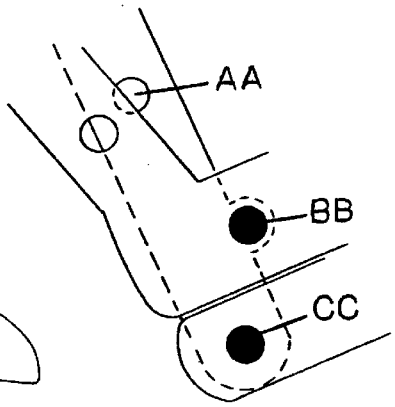

Offsetting one of the compound lever pivots at AA and referencing it to CC thus has the following advantages over the configuration of FIGS. 5–6 (also see FIGS. 11*a*–11*c*):

a) It mitigates the potential problem of fluctuating distances between moving assembly components as previously described.
b) It allows a seated user to maintain a constant horizontal relationship between his or her forearms and the pads of the arm rest assembly while changing position and/or effecting a rocking motion.
c) While maintaining a constantly level armrest assembly may appear to be desirable for keyboard operation (FIGS. 5–6*a* and 11*a*–11*b*) many users will find the 9 degrees of armrest tilt afforded by this configuration more natural and thus more comfortable for general chair operation. A user can always manually override any degree of tilt the assembly is automatically delivering through positional displacement of the armrest assembly (see FIG. 15).

In FIGS. 9–9*a* and 10–10*a* the linked tilt range of the armrest assembly is 18 degrees and the differential tilt is 0 degrees. (18 degrees−18=0). Armrest assembly 4 is fixedly mounted to upper rails 2*m* and 2*n* by means of pivots AA and BB (which function here as arbitrary fastening points). Since the armrest assembly is here linked to the movements of a single, not a compound lever, its linked tilt range will equal that of the lever's tilt range. Thus there is no differential in tilt between assembly 4 and assembly 2 for this configuration. The movements of lower rails 2*o* and 2*p* here have no effect on the armrest assembly, and 2*o* and 2*p* have no function within the assembly rearward of their fulcrum at 2*d*. Since this mount creates no differential tilt a seated user must manually effect a positional displacement of the armrests (see FIG. 15).

FIGS. 11*a*–11*c* illustrate an alternative embodiment of the compound lever assembly. In FIGS. 11*a*–11*c* compound lever assembly 2' consists of the same elements (not shown) as compound lever assembly 2. (Certain elements may be refit as needed). Upper and lower right side offset rails 2*m*', 2*n*', 2*o*' and 2*p*' have been shaped to raise the positions of dual pivots xx and yy relative to their equivalent pivots bb and cc in FIGS. 5–6*a*. Raising the pivots on their arc of travel closer to the horizontal of fulcrums 2*c* and 2*d* diminishes the change in horizontal distance between the vertical axes formed by xx–yy, 2*c*–2*d* and 2I–2*j* (see the discussion of FIGS. 5–6*a* above).

It can be seen that the equal and parallel pivots in 11*b* now form a compound parallelogram, or two parallelograms with a common side at vertical axis 2*c*–2*d*. Armrest assembly 4 (not shown) mounted to 4*a* moves on a vertical axis as lever assembly 2' tilts from FIG. 11*a* to FIG. 11*b*. In FIGS. 11*a*–11*b* the linked tilt range of the armrest assembly is 0 degrees and the differential tilt is 18 degrees. (18 degrees–

0=18). A seated user would thus experience no change in the horizontal inclination of the armrest pads as he or she reclined in the chair, and only a slight variation in the fore-aft positioning of the assembly. In all other respects the discussion of FIGS. 5–6*a* above applies to 11*a*–11*b*.

Figure 7:
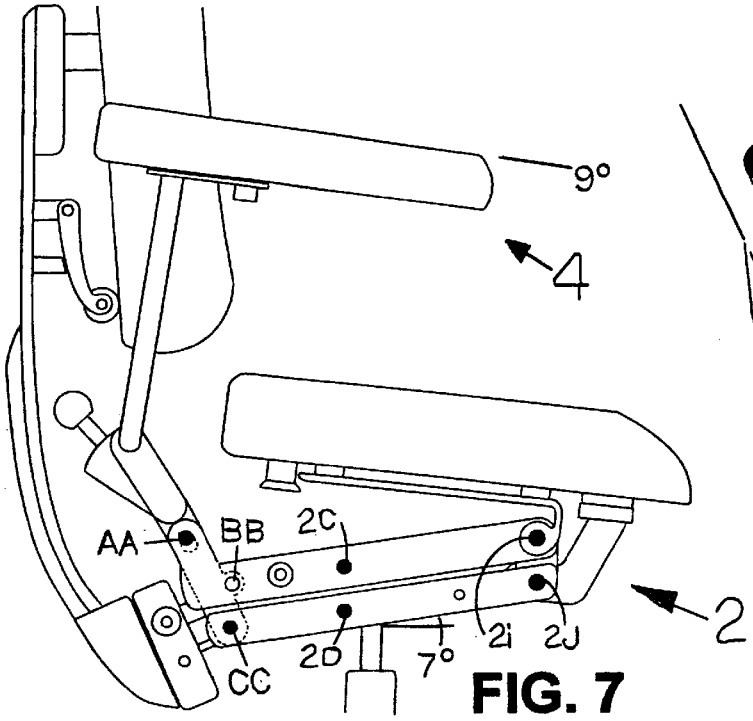
Figure 7A:
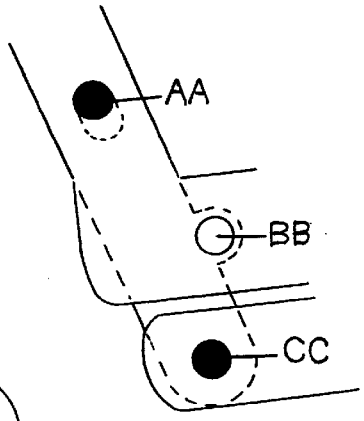
Figure 8:
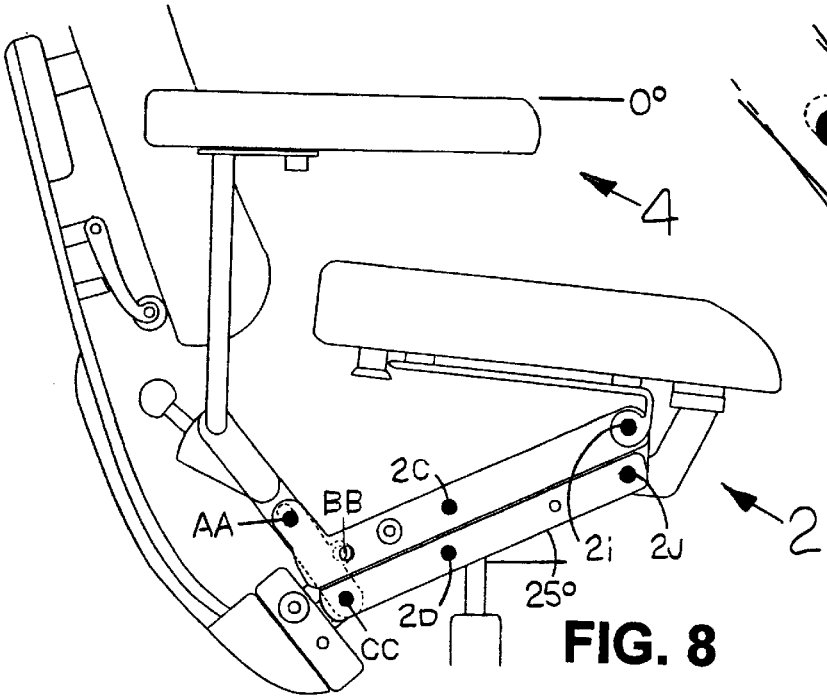
Figure 8A:
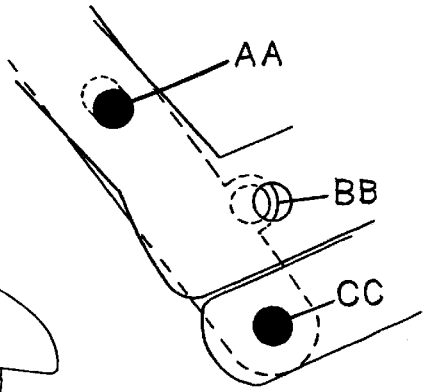

FIG. 11*c* shows the same mount as described in the discussion of FIGS. 7–8*a* above. Pivots xx/aa and zz/cc are equivalent, and the linked tilt range and differential tilt are identical to those of FIGS. 7–8*a*. It should be reiterated that this mount draws the armrest assembly rearward slightly more than the mount of FIG. 11*b*, possibly creating a preferable overall body to chair alignment for a seated user.

FIG. 12 shows a relational summary of the linked tilt ranges and differential tilts created by the interaction of assemblies 2 and 4 as shown in FIGS. 5–11*c*. This summary posits a compound lever assembly with a tilt range of 18 degrees. Double numbers (0-0, 9-0, 18-0) represent the beginning and ending inclinations from the horizontal of the armrest assemblies as the respective linked tilt ranges are effected. Numbers in parenthesis represent the differential tilt. The actual linked tilt ranges for each armrest configuration begin at the illustrated forward tilt and end at the horizontal. The horizontal is here represented as 0 degrees. The ending horizontal positions are not shown; see FIGS. 5*a*–11*c*. All numbers should be accepted as a close approximation.

0-0 degrees is the linked tilt range of armrest tilt and 18 degrees is the differential tilt created by the mount of FIGS. 5–6*a* and 11*b*.

9-0 degrees is the linked tilt range of armrest tilt and 9 degrees is the differential tilt created by the mount of FIGS. 7–8*a* and 11*c*.

Figure 9:
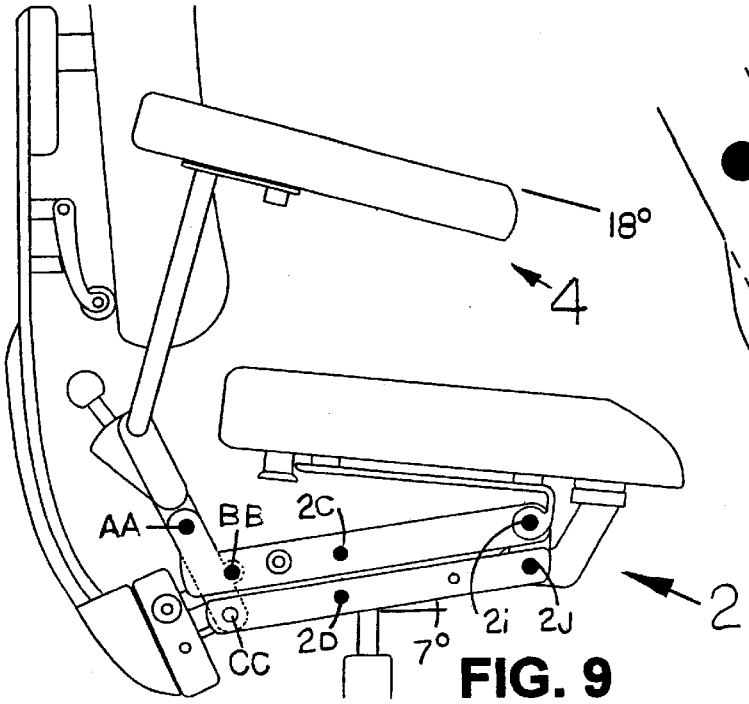
Figure 9A:
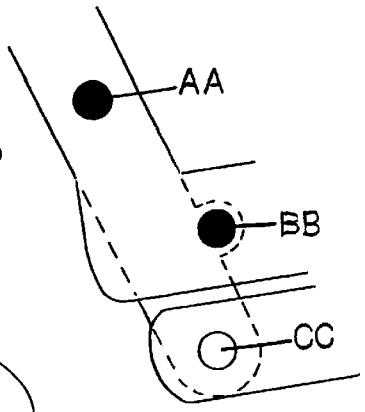
Figure 10:
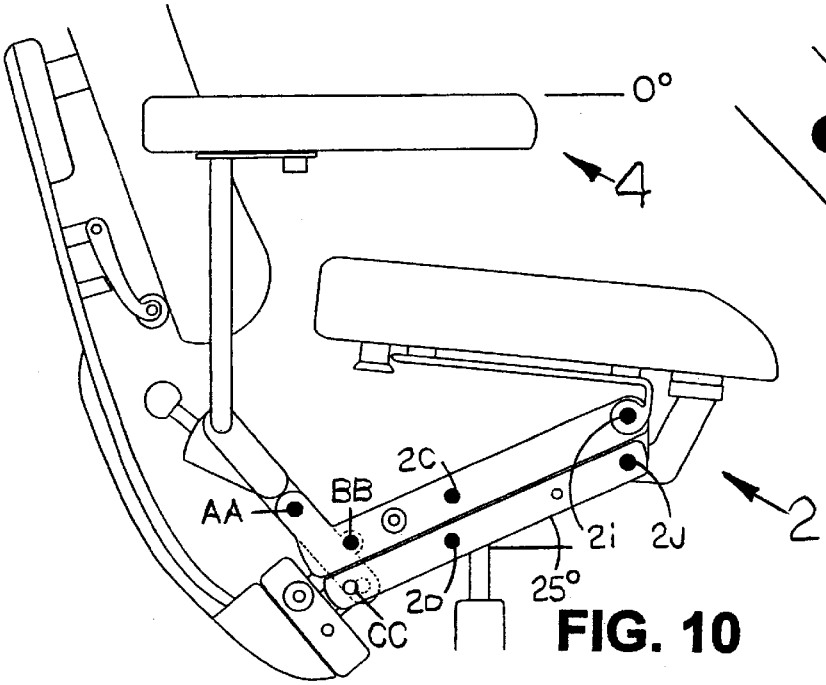
Figure 10A:
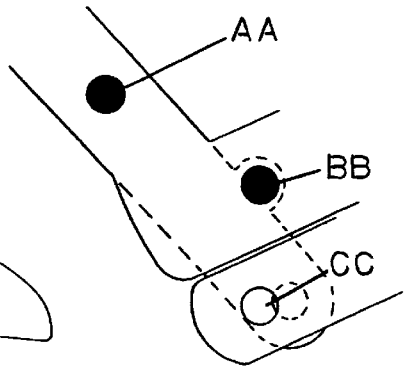

18-0 degrees is the linked tilt range of armrest tilt and 0 degrees is the differential tilt created by the mount of FIGS. 9–10*a*.

FIG. 13 shows an exploded drawing of one possible embodiment of armrest assembly 4. Two left and right bushings 4*j* and 4*k* have oppositely threaded interiors (LH and RH); the bushings mate onto threaded rod 4*m*. The assembled rod and bushings mate into the interior of housing 4*e* where the rod is kept in place by keepers 4*n* and keeper screw 4*f* (4*f* sits flush with the surface of housing 4*e* when installed). The bushings are kept from rotating by the mating of their bushing exterior surface 41 to the inner housing's interior surface 4*g*; any equivalent method may be used. This assembly slides into main armrest assembly housing 4*a* where it may turn freely and is kept in place by a housing flange and limiter plate 4*h*. The rotation of the inner housing 4*e* inside outer housing 4*a* is limited by the mating of limiter plate 4*h* and striker plate 4*b*. A pin assembly 4*c*, fixed to 4*b*, injects a pin into a chosen hole of pinhole plate 4*i*, thus holding the housings in place; this adjustment configures the fore and aft tilt (positional displacement) of the armrest assembly. Any type of appropriate locking mechanism may be employed at this point. The assembled housing is mounted onto lever assembly 2 at pivots AA, BB, or CC (see FIG. 2). A spring 4*d* maintains forward rotational pressure between inner housing 15 and outer housing 16; thus when a user pulls the pin of assembly 4C the armrests tilt forward under spring pressure. Two left and right armrest upright assemblies, 4O and 4P are employed. Two left and right armrest uprights 4*q* and 4*r* are mounted onto the exposed ends of bushings 4*j* and 4*k*; their default orientation is determined by the positional displacement at 4C. Two left and right armrest extenders 4*s* and 4*t* are inserted into the uprights where their vertical height is limited by a mating of their teeth with a hammer pin contained in left and right hammer pin assemblies 4*u* and 4*v*. A left and right gear knob 4*w* and 4*x* is mounted to uprights 4*q* and 4*r*; its teeth mate with teeth on extenders 4*s* and 4*t* so that a seaed user may turn the knob to raise the elevation of the armrests. The rests are lowered by pulling out on hammer pin assemblies 4*u* and 4*v*; an alternate embodiment would raise and lower the extenders exclusively from 4*v*–4*w*. A pair of armrest pads and supports 4*y* and 4*z* is mounted onto upright extenders 4*s* and 4*t* so that they may rotate on the horizontal, shown by phantom position 4*y*–4*z*. Two accessory mounts 7*a* and 7*b* are fixed to the tops of extenders 4*s* and 14*t*.

FIG. 14 shows an assembled version of armrest assembly 4. By turning the knob of threaded rod 4*m* its mounted bushings 4*j* and 4*k* move laterally and in opposite directions, thus effecting the lateral adjustments of armrest upright assemblies 4O and 4P, movements represented by positions 4O–*x* and 4P–*x*. While the movements are not shown it is understood that upright extenders 4*s* and 4*t* move vertically within uprights 4*q* and 4*r*, thus effecting height adjustment of the armrest assemblies.

FIG. 15 shows a possible range of user effected tilt of the armrest assembly (positional displacement). By unlocking the assembly at 4C a user may then cause the assembly to rotate within its housing to the desired inclination, whereupon 4C is released and the assembly is locked down again. This new position becomes the default for all further armrest movements referenced to lever assembly 2. The actual degree of positional displacement will run at about 8 degrees. The potential range of motion of the seat pan 3–3' is here reiterated.

FIG. 16 shows armrest assembly 4 with a desk assembly 8 mounted to either of accessory mounts 7*a* or 7*b*.

FIG. 17 shows armrest assembly 4 with an abdominal rest assembly 9 mounted to either of accessory mounts 7*a* or 7*b*.

FIG. 18 shows a possible base configuration for the chair herein described. Compound lever assembly mounts to upright stem 6*a*; a seated user may employ the legrest assembly 6B.

List of Parts

AA Dual pivot, upper
BB Dual pivot, mid
CC Dual pivot, lower
XX Dual pivot, upper
YY Dual pivot, mid
ZZ Dual pivot, lower
1 Chair assembly
2 Compound lever assembly
2' Compound lever assembly, alternate
2*a* Main mounting assembly
2*b* Mounting plate
2*c* Upper main axle
2*d* Lower main axle
2*e* Main return spring
2*f* Tilt lock assembly
2*g* Front axle assembly
2*h* Front axle mount
2*i* Upper front axle
2*j* Lower front axle
2*k* Seat pan return spring
2*l* Seat pan stop
2*m* Upper left side rail
2*n* Upper right side rail
2*o* Lower left side rail
2*p* Lower right side rail
2*m*' Upper left side rail, offset

2*n*' Upper right side rail, offset
2*0*' Lower left side rail, offset
2*p*' Lower right side rail, offset
2*q* Top plate
2*r* Backrest mount assembly
2*s* Mounting plate
2*t* Coupler housing
2*u* Braking assembly
2*v* Mounting axle
2*vl* Left bearing
2*vr* Right bearing
2*w* Tilt axle
2*x* Tilt adjust springs
2*y* Main spring shaft
2*z* Main return spring
3 Seat pan assembly
3*a* Seat pan mount L
3*b* Seat pan mount R
3*c* Seat pan cushion
4 Armrest Assembly
4*a* Main armrest assembly housing
4*b* Striker plate
4*c* Pin assembly
4*d* Return spring
4*e* Inner housing
4*f* Keeper screw
4*g* Inner housing interior surface (representation)
4*h* Limiter plate
4*i* Pin hole plate
4*j* LH Bushing
4*k* RH Bushing
4*l* Bushing exterior surface (representation)
4*m* Threaded rod
4*n* Keepers
4*o* LH Armrest Upright Assembly
4*p* RH Armrest Upright Assembly
4*q* Armrest upright, L
4*r* Armrest upright, R
4*s* Armrest extender, L
4*t* Armrest extender, R
4*u* Pin assembly, L
4*v* Pin assembly, R
4*w* Gear knob, L
4*x* Gear knob, R
4*y* Armrest pad, L
4*z* Armrest pad, R
5 Backrest assembly
5A Backrest Upright Assembly
5*b* Backrest cushion
5C Wedge and Pivot Assembly
5*d* Cushion Pivot Assembly
6 Base assembly
6*a* Upright stem
6B Legrest assembly
7*a* Accessory mount, L
7*b* accessory mount, R
8 Desk Assembly
Abdominal Rest

What is claimed is:

1. A system for supporting a seatpan on a chair and for providing movement to an armrest on the chair, the system comprising:

mounting assembly comprising:

an upper rail having a front portion, a mid portion and a rear portion;

a lower rail having a front portion, a mid portion and a rear portion;

means for pivotally joining said upper rail to said lower rail and allowing generally parallel motion of the rails relative to one another;

means for supporting said mounting assembly;

an armrest support pivotally attached to said mounting assembly; and, means for indexing movements of said armrest support relative to motion of the position of the upper rail relative to lower rail, so that motion of the upper rail relative to the lower rail produces a corresponding tilt of said armrest support.

2. A system according to claim 1 and further comprising means for pivotally supporting a seat from the front portion of said lower rail.

3. A system according to claim 2 and further comprising means for selectively limiting the pivotal motion of a seat mounted on said means for pivotally supporting a seat.

4. A system according to claim 1 and further comprising:

an armrest mounted on said armrest support; and means for adjusting the horizontal distance between the armrest and said mounting assembly.

5. A system according to claim 4 wherein said mounting assembly further comprises means for accepting a backrest support near the rear portion of said mounting assembly.

6. A system according to claim 1 wherein said mounting assembly further comprises a support plate adapted for attaching to said means for pivotally supporting said mounting assembly.

7. A system according to claim 1 and further comprising means for connecting the rear portion of said upper rail and the rear portion of said lower rail to said armrest support.

8. A system according to claim 1 wherein the front portion and mid portion of said upper rail are along a line and the rear portion of the upper rail is at a distance from the line, so that the upper rail is generally L shaped.

9. A chair comprising:

a base with a vertical stem;

a generally horizontal compound lever assembly comprising:

an upper rail and a lower rail of similar lengths pivotally mounted to a dual fulcrum and pivotally fixed to said vertical stem, the dual fulcrum being along a generally vertical axis;

a seat pan mount with an upper pivot and a lower pivot, the pair of pivots being indexed to the dual fulcrum, so that a vertical inclination of said seat pan mount remains constant as said seat pan mount tilts in tandem with said compound lever, and so that a differential in degree of tilt is created between the horizontal axis of said mount and that of said compound lever as said lever tilts over its range;

an armrest mount with an upper and a lower pivot attached to the rearward section of said compound lever so that the vertical axis and spacing of its pivots is parallel and equal to those of said fulcrum, and so that the vertical inclination of said armrest mount remains constant as said mount tilts in tandem with said compound lever, and so that a differential in degree of tilt is created between the horizontal axis of said armrest mount and that of said compound lever as said lever tilts over its range.

10. A chair according to claim 9 and further comprising at least one arm rest on said arm rest mount; and a backrest mount pivotally attached to said compound lever assembly, so that said backrest tilts in tandem with one of said levers.

11. A chair according to claim 10 wherein said armrests are part of an assembly generally comprising:

two vertical upright supports and armrest pads with means for adjusting the vertical height of the supports;

means to fixedly interconnect said two vertical supports so that their vertical inclination is held constant to each other, said means forming a horizontal axis on which said assembly may rotate;

means to vary the vertical inclination of said armrest assembly by rotating and locking said assembly on said horizontal axis;

means to vary the horizontal distance of said means of connecting said vertical supports wherein said means concurrently move said vertical supports equal distances in opposite directions.

12. The chair of claim 11 wherein said base includes support for a user's legs and feet.

13. A method for providing variation in tilt between a seatpan on a chair and a pair of armrest on the chair, the method comprising:

providing a mounting assembly comprising:

an upper rail having a front portion, a mid portion and a rear portion;

a lower rail having a front portion, a mid portion and a rear portion;

means for pivotally joining said upper rail to said lower rail and allowing generally parallel motion of the rails relative to one another;

supporting said mounting assembly from a location near the mid portion of the upper rail and the mid portion of the lower rail;

pivotally attaching an armrest support to said mounting assembly; and, indexing movements of said armrest support relative to motion of the position of the upper rail relative to lower rail, so that motion of the upper rail relative to the lower rail produces a corresponding variation in tilt of said armrest support.

14. A method according to claim 13 and further comprising means the step of pivotally supporting a seat from the front portion of said lower rail.

15. A method according to claim 14 and further comprising the step of selectively limiting the pivotal motion of a seat mounted on said means for pivotally supporting a seat.

16. A method according to claim 13 and further comprising the step of:

providing an armrest mounted on said armrest support; and adjusting the horizontal distance between the armrest and said mounting assembly.

17. A method according to claim 15 wherein said mounting assembly further comprises means for accepting a backrest support near the rear portion of said mounting assembly.

18. A method according to claim 13 wherein the front portion and mid portion of said upper rail are along a line and the rear portion of the upper rail is at a distance from the line, so that the upper rail is generally L shaped.

* * * * *